US007048043B2

(12) United States Patent
Leterrible et al.

(10) Patent No.: US 7,048,043 B2
(45) Date of Patent: May 23, 2006

(54) REVERSIBLE GROOVED TUBES FOR HEAT EXCHANGERS

(75) Inventors: Pascal Leterrible, Dangu (FR); Nicolas Avanan, Talmontier (FR)

(73) Assignee: Trefimetaux, Courbevoie (FR)

( * ) Notice: Subject to any disclaimer, the term of this patent is extended or adjusted under 35 U.S.C. 154(b) by 0 days.

(21) Appl. No.: 10/120,782

(22) Filed: Apr. 12, 2002

(65) Prior Publication Data

US 2003/0173071 A1 Sep. 18, 2003

(30) Foreign Application Priority Data

Mar. 12, 2002 (FR) ..... 02 03067

(51) Int. Cl.
*F28F 1/36* (2006.01)

(52) U.S. Cl. ..... 165/184; 165/133

(58) Field of Classification Search ..... 165/184, 165/133, 109.1

See application file for complete search history.

(56) References Cited

U.S. PATENT DOCUMENTS

| | | | | | |
|---|---|---|---|---|---|
| 5,259,448 | A | * | 11/1993 | Masukawa et al. | 165/133 |
| 5,332,034 | A | * | 7/1994 | Chiang et al. | 165/184 |
| 5,682,946 | A | * | 11/1997 | Schmidt et al. | 165/133 |
| 5,692,560 | A | | 12/1997 | Messant et al. | |
| 6,164,370 | A | * | 12/2000 | Robinson et al. | 165/133 |
| 6,176,301 | B1 | * | 1/2001 | Bennett et al. | 165/133 |
| 6,308,775 | B1 | * | 10/2001 | Naumann | 165/133 |

FOREIGN PATENT DOCUMENTS

| | | | | |
|---|---|---|---|---|
| EP | 0148609 | | 7/1985 | |
| EP | 0518312 | | 12/1992 | |
| EP | 0591094 | | 4/1994 | |
| JP | 402037292 | * | 2/1990 | 165/184 |
| JP | 404302999 A | * | 10/1992 | |
| JP | 405141890 | * | 6/1993 | 165/184 |
| JP | 08049992 A | * | 2/1996 | |
| JP | 09021594 | | 5/1997 | |

* cited by examiner

*Primary Examiner*—Tho Duong
(74) *Attorney, Agent, or Firm*—Dennison, Schultz, Dougherty & MacDonald

(57) ABSTRACT

Grooved metal tubes (1), of outer diameter De, the tubes being grooved internally with N helical ribs (2) of an apex angle α, height H, base width $L_N$ and helical angle β, two consecutive ribs being separated by a flat-bottomed groove (3) of width $L_R$, with a pitch P equal to $L_R+L_N$. These tubes are characterised in that, a) De is between 4 and 20 mm,
b) the number N of ribs ranges from 46 to 98,
c) the rib height H ranges from 0.18 mm to 0.40 mm,
d) the apex angle α ranges from 15° to 30°,
e) the helical angle β ranges from 18° to 35°. These tubes make it possible to simultaneously obtain a high heat exchange coefficient in evaporation and condensation and a low pressure loss.

23 Claims, 6 Drawing Sheets

REVERSIBLE GROOVED TUBES FOR HEAT EXCHANGERS

FIELD OF THE INVENTION

The invention relates to the field of heat exchanger tubes, and more specifically the field of heat exchangers operating in evaporation/condensation and in reversible mode.

DESCRIPTION OF RELATED ART

A large number of documents disclosing the geometry of grooved tubes used in heat exchangers are known.

For example, it is possible to mention the patent application EP-A2-0 148 609 which discloses triangular or trapezoidal grooved tubes comprising the following characteristics:

an H/Di ratio between 0.02 and 0.03, where H refers to the depth of the grooves (or height of the ribbing), and Di the inner diameter of the grooved tube, a helical angle β with reference to the tube axis between 7 and 30°, an S/H ratio between 0.15 and 0.40, where S refers to the cross-section of the groove, an apex angle α of the ribbing between 30 and 60°.

These tube characteristics are suitable for phase transition fluids, the tube performances being analysed clearly when the fluid evaporates or when the fluid condenses.

The Japanese application No. 57-580088 discloses V-shaped grooved tubes, with H between 0.02 and 0.2 mm and an angle β between 4 and 15°.

Similar tubes are disclosed in the Japanese application No. 57-58094.

The Japanese application No. 52-38663 discloses V or U-shaped grooved tubes, with H between 0.02 and 0.2 mm, a pitch P between 0.1 and 0.5 mm and an angle β between 4 and 15°.

The U.S. Pat. No. 4,044,797 discloses V or U-shaped grooved tubes similar to the above tubes.

The Japanese certificate for use No. 55-180186 discloses tubes with trapezoidal grooves and triangular ribbing, with a height H of 0.15 to 0.25 mm, a pitch P of 0.56 mm, an apex angle α (angle referred to as θ in this document) typically equal to 73°, an angle β of 30°, and a mean thickness of 0.44 mm.

The U.S. Pat. No. 4,545,428 and No. 4,480,684 disclose tubes with V-shaped grooves and triangular ribbing, with a height H between 0.1 and 0.6 mm, a pitch P between 0.2 and 0.6 mm, an apex angle α between 50 and 100°, a helical angle β between 16 and 35°.

The Japanese patent No. 62-25959 discloses tubes with trapezoidal grooves and ribbing, with a groove depth H between 0.2 and 0.5 mm, a pitch P between 0.3 and 1.5 mm, the mean groove width being at least equal to the mean ribbing width. In one example, the pitch P is 0.70 and the helical angle β is 10°.

Finally, the European patent EP-B1-701 680, held by the applicant, discloses grooved tubes, with typically flat-bottomed grooves and with ribbing of different height H, a helical angle β between 5 and 50°, an apex angle α between 30 and 60°, so as to obtain improved performances after the crimping of tubes and assembly in exchangers.

As a general rule, the technical and economical performances of the tubes, which are the result of the choice of the combination of means defining the tubes (H, P, α, β, shape of grooves and ribbing, etc.), must satisfy four requirements relating to:

firstly, the characteristics relating to heat transfer (heat exchange coefficient), a field wherein grooved tubes are very superior to non-grooved tubes, such that at an equivalent heat exchange, the length of grooved tube required will be less than that of a non-grooved tube, secondly, the characteristics relating to pressure losses, low pressure losses enabling the use of pumps or compressors of lower power, size and cost, also, the characteristics relating to the mechanical properties of the tubes, typically in relation to the type of alloys used or the mean tube thickness, which determines the weight of the tube per unit of length, and therefore influences its cost price, finally, the industrial feasibility of the tubes and production rates which determines the cost price of the tube for the tube manufacturer.

Firstly, as they are a result of the prior art, there are a large number and very wide range of disclosures relating to grooved tubes, given that they generally aim to optimize heat exchange and a decrease in pressure loss.

Secondly, each of these disclosures in turn frequently offers a wide range of possibilities, the parameters being generally defined by relatively wide ranges of values.

Finally, these disclosures relate to, when specified, exchanges with coolant, which, typically, evaporates or condenses in the refrigerating circuit, the coolant having different evaporation and condensation behaviour. To date, these disclosures relate to grooved tubes for exchangers operating either in condensation or in evaporation.

Definitively, those skilled in the art already encounter considerable difficulties in extracting the quintessence of the prior art, from such a wide range of sometimes contradictory data.

However, those skilled in the art know that a typical commercially available tube, with triangular ribbing as represented in FIG. 1, typically comprises the following characteristics: outer diameter De=12 mm, rib height H=0.25 mm, tube wall thickness Tf=0.35 mm, number of ribs N=65, helical angle β=15°, apex angle α=55°.

So as to meet a market demand, the aim of the present invention relates to tubes for exchangers with reversible applications, i.e. tubes or exchangers which can be used with phase transition coolants, both in evaporation and in condensation, i.e. either for cooling, for example as air conditioning units, or for heating, for example as heating means, typically of air or a secondary fluid.

More specifically, the present invention relates to tubes which not only offer an excellent compromise between thermal performances in coolant evaporation mode and condensation mode, but which, in addition, intrinsically show high performances both in terms of evaporation and condensation.

Therefore, the applicant researched tubes and exchangers which are economical, with a relatively low weight per metre, and high heat exchange performances, both in terms of evaporation and condensation.

SUMMARY OF THE INVENTION

According to the invention, the grooved metal tubes, of thickness $T_f$ at the bottom of the groove, outer diameter De, typically intended for the manufacture of heat exchangers operating in evaporation or condensation or in reversible mode and using a phase transition coolant, grooved internally with N helical ribs of an apex angle α, height H, base width $L_N$ and helical angle β, two consecutive ribs being separated by a typically flat-bottomed groove of width $L_R$, with a pitch P equal to $L_R+L_N$, are characterised in that, a) the outer diameter De is between 4 and 20 mm, b) the number N of ribs ranges from 46 to 98, particularly as a function of the diameter De, c) the rib height H ranges from 0.18 mm to 0.40 mm, particularly as a function of the diameter De, d) the apex angle α ranges from 15° to 30°, e) the helical angle β ranges from 18° to 35°, so as to obtain simultaneously a high heat exchange coefficient both in evaporation and condensation, a low pressure loss and the lightest possible tube, without inducing an additional cost in relation to specific tubes for evaporation or condensation.

Following its research work, the applicant succeeded in solving the problems posed by the combination of means and all the above characteristics.

The characteristic defined in a defines the range of outer diameter De of the tubes in the target field of application of the tubes according to the invention.

The characteristic in b, relating to the number N of grooves, and therefore to the corresponding pitch P, specifies that this number must be relatively high. The applicant's tests with finned batteries demonstrated that this number of grooves has a major influence on the thermal performance of the exchangers.

In this way, for example, for a tube diameter De 9.52 mm:

when the number N is less than 46, it was observed that the performance of the exchanger dropped considerably, relating to the upper limit of the number N, it is essentially technological and practical in nature, and depends on the technical manufacturing possibilities for grooved tubes; therefore, this upper limit varies and increases with the tube diameter De.

It was observed on a tube of diameter De of 12 mm that a number of ribs N of 98 guarantees a high thermal performance of the exchanger in evaporation and condensation.

Relating to the characteristic in c, relating to the height H of the ribs or depth of the grooves, the limits of H are the result of the following observations:

for values of H greater than 0.40 mm, a lower technical feasibility was observed, since it is not easy to manufacture very high ribs, and an increase in the pressure loss was also observed, for values of H less than 0.20 mm, it was observed that the heat exchange performance is excessively diminished and becomes insufficient.

Said height H may vary with the tube diameter, the larger diameter tubes preferentially having higher ribs.

The characteristic in d, relating to the apex angle α, specifies that this angle must be selected in a relatively narrow range (15°–30°) and with relatively low apex angle values α.

Firstly, a low apex angle value α is preferable to improve the heat transfer performance to reduce the pressure loss and reduce the tube weight/m. The lowest angle α is obtained with trapezoidal ribbing.

However, the lower limit is essentially related to the manufacture of grooved tubes according to the invention to retain a high production rate.

The characteristic in e, relating to the helical angle β, demonstrates that this angle must be at least equal to 18° to solve the problems of the invention, and at most equal to 35° due to the significant increase in pressure losses, particularly with certain coolants, for example the coolant R134a.

Relating to the thickness Tf of the tube at the bottom of the groove, it may vary as a function of the diameter De, so as to obtain, at the same time, sufficient mechanical properties, particularly resistance to internal pressure, maximum material preservation, and therefore an optimised material cost, and the lowest possible weight per metre. This thickness Tf is 0.28 mm for a tube of diameter De of 9.55 mm, and 0.35 mm for a tube of diameter De of 12.7 mm.

All these means make it possible to define a selection of tubes, specific tubes particularly suitable for exchangers with phase transition coolants, so as to obtain simultaneously a high heat exchange coefficient in evaporation and condensation, a low pressure loss and the lightest possible tube.

BRIEF DESCRIPTION OF THE DRAWINGS

FIGS. 1*a* and 1*b* are diagrams to illustrate the significance of the different parameters used to define the tubes according to the invention, in which:

FIG. 1*a* represents a partial view of a grooved tube 1, in a partial section along the tube axis, so as to illustrate the helical angle β; and FIG. 1*b* represents a partial view of a grooved tube 1, in a partial section perpendicular to the tube axis, so as to illustrate the case of a tube comprising a succession of ribs 2 of height H, said ribs being roughly triangular in shape, of base width $L_N$ and apex angle α, separated by grooves 3 roughly trapezoidal in shape and of width $L_R$, $L_R$ being the distance between two ribbing grooves. Said tube has a thickness Tf, an outer diameter De, an inner diameter Di and a pitch P equal to $L_R+L_N$.

FIGS. 2*a* to 2*c* are partial sections of a tube of diameter De of 8 mm and of thickness Tf of 0.26 mm, according to an example of an embodiment of the invention, wherein the ribbing forms an alternation of trapezoidal ribbing of height H1 and height H2<H1, at different scales, in which:

FIG. 2*a* represents 3 complete ribs 2 and 2 partial ribs, separated by grooves 3, at a scale of "200 μm";

FIG. 2*b* represents 2 complete ribs at a scale of "100 μm"; and

FIG. 2*c* represents a single rib 2 at a scale of "50 μm".

Figure 3:
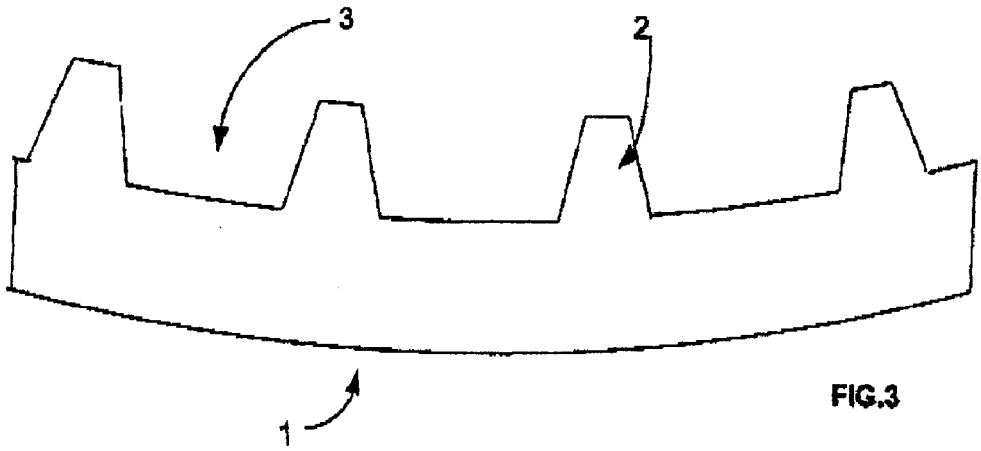
FIG. 3 represents a partial section of a tube of diameter De of 9.52 mm and of thickness Tf of 0.30 mm according to the invention.
Figure 4:
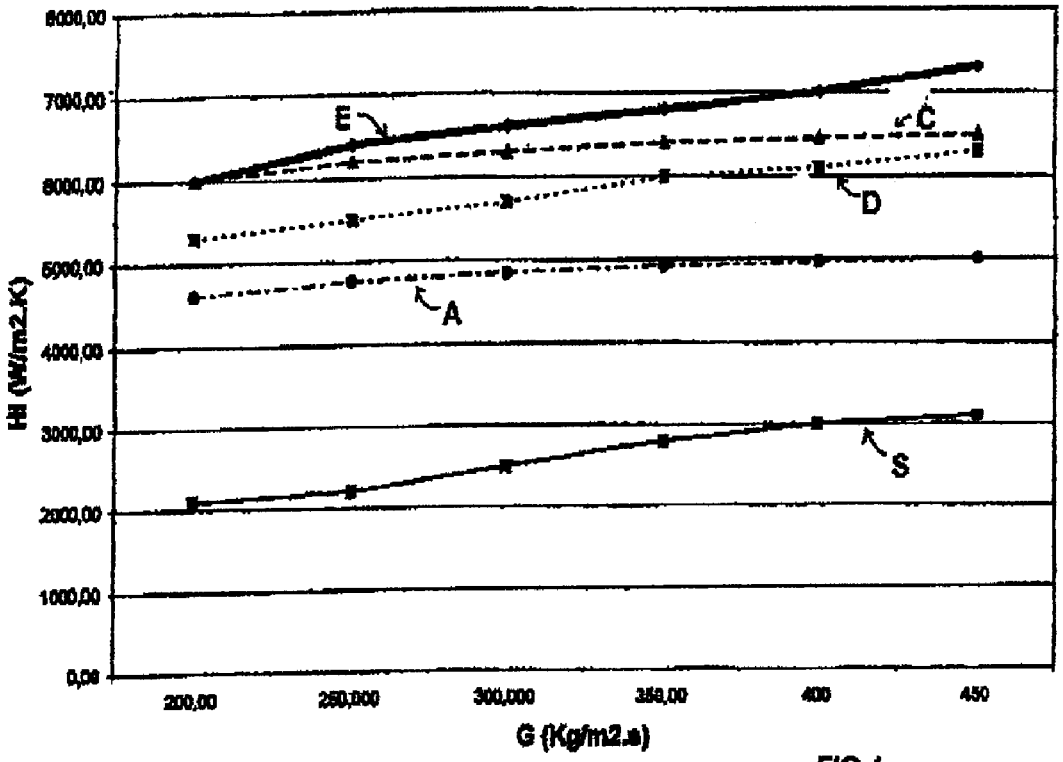
FIG. 4 is a graph of different curves which give, in condensation at 30° C. with fluid R22, the exchange coefficient Hi (in $W/m^2 \cdot K$) on the Y-axis as a function of the fluid flow rate G on the X-axis (in $kg/m^2 \cdot s$).
Figure 5:
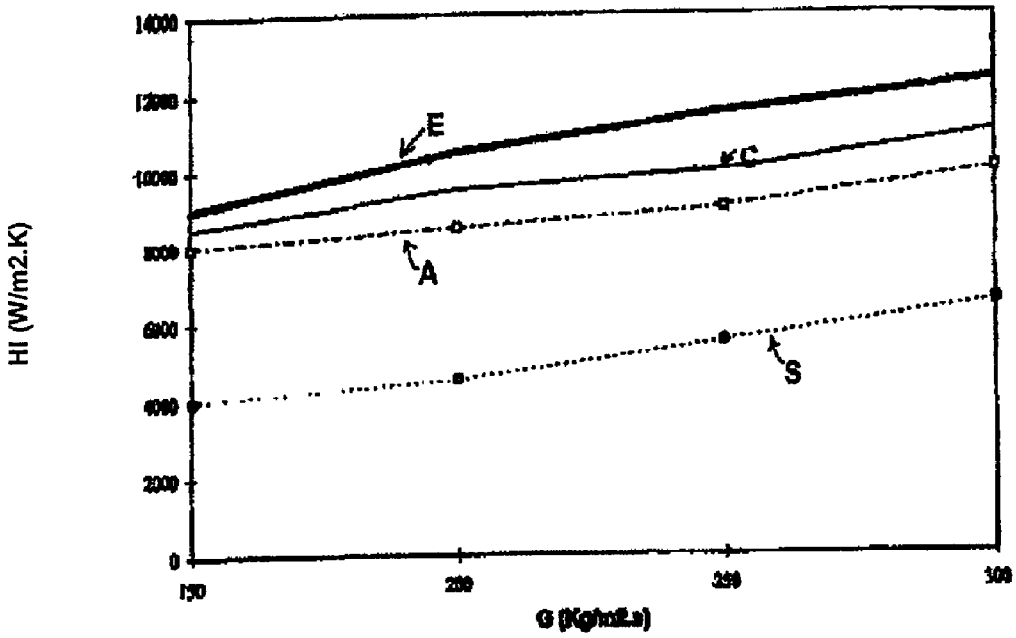
FIG. 5 is a graph of different curves which give, in evaporation at 0° C. with the fluid R22, the exchange coefficient Hi (in $W/m^2 \cdot K$) on the Y-axis as a function of the fluid flow rate G on the X-axis (in $kg/m^2 \cdot s$).

These curves correspond to a tube according to the invention—referred to as E in FIG. 3, and to tubes according the prior art referred to as "A", "C", "D" and "S", all said tubes being of the same outer diameter De=9.52 mm. See the examples of embodiments.

Figure 6:
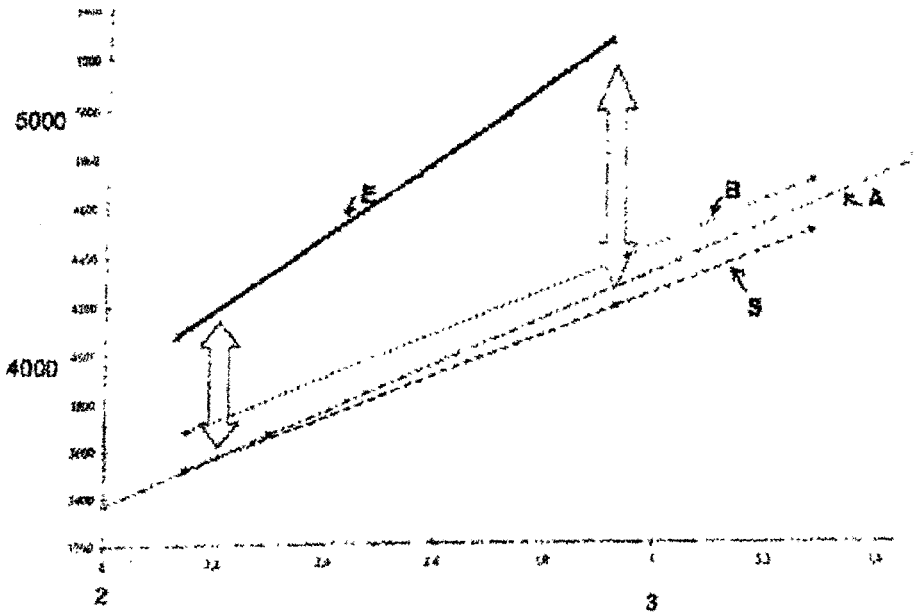
Figure 7:
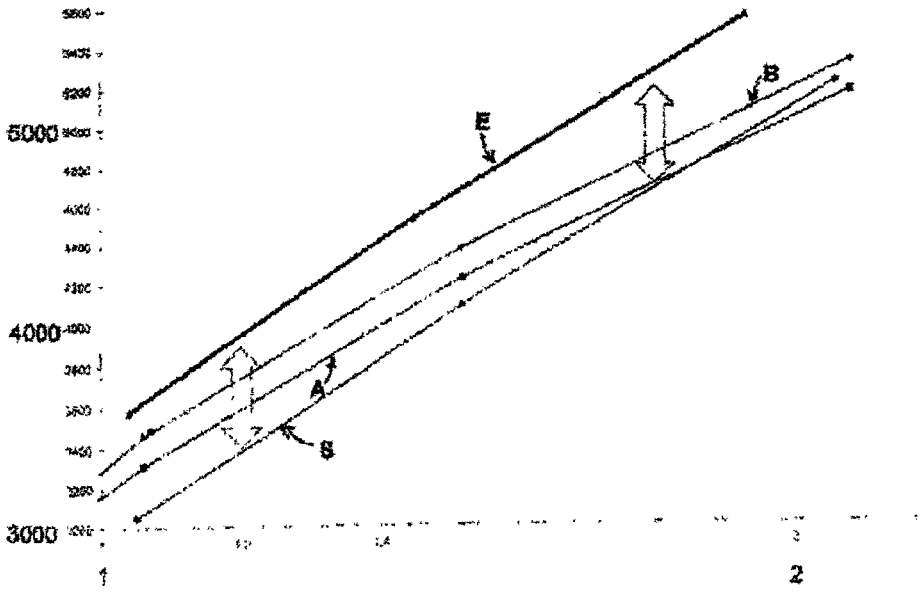

FIGS. 6 and 7 are graphs which show, on the Y-axis, the refrigerating exchange capacity measured in Watts of a battery of tubes and fins, as a function of, shown on the X-axis, the frontal air velocity circulating between the fins expressed in m/s.

Figure 1A:
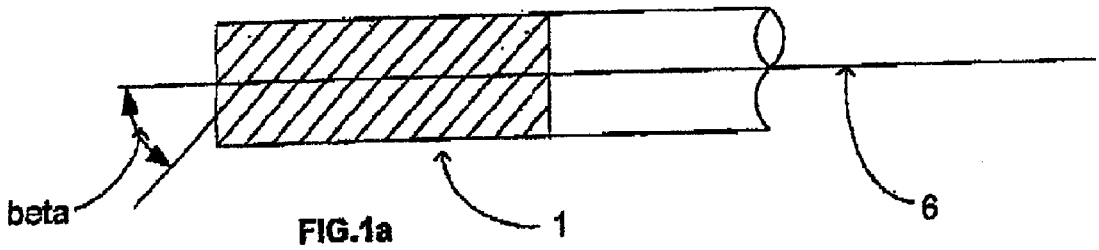
Figure 1B:
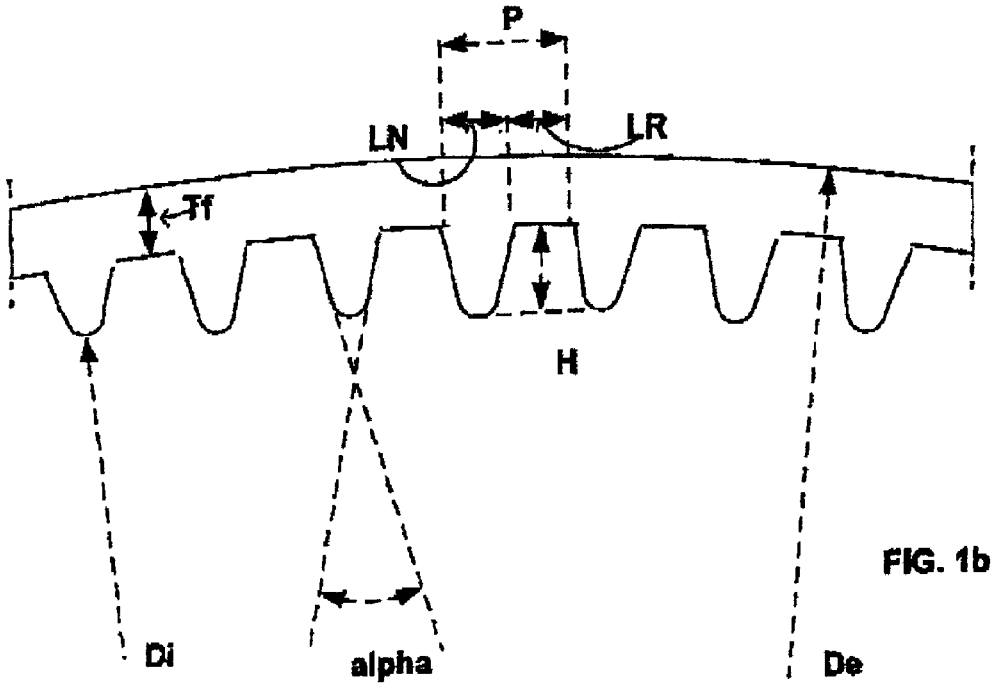
Figure 2A:
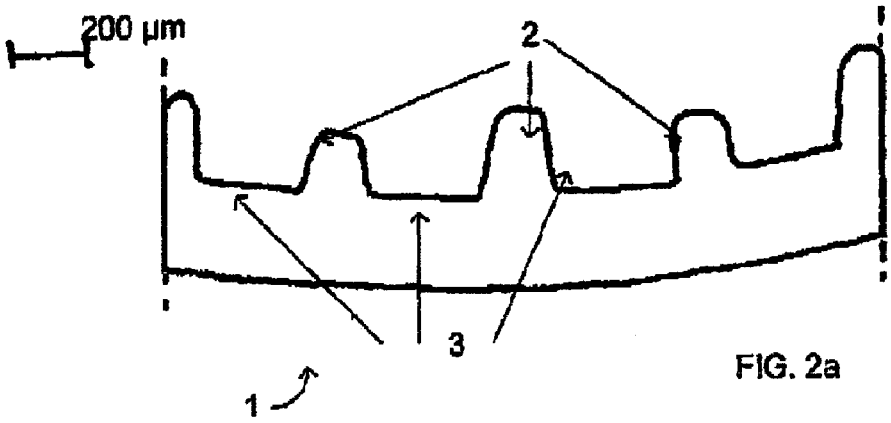
Figure 2B:
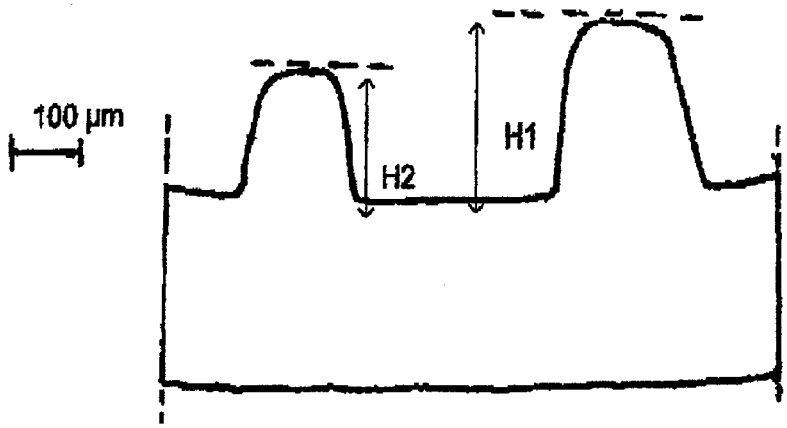
Figure 2C:
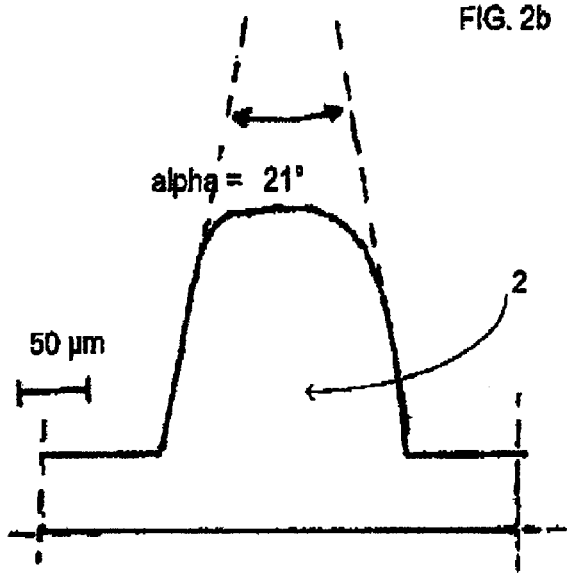

These curves correspond to a tube according to the invention—referred to as E, in FIGS. 2*a* to 2*c*, and to tubes according the prior art referred to as "A", "B" and "S", all said tubes being of the same outer diameter De=8.00 mm. See the examples of embodiments.

Figure 8:
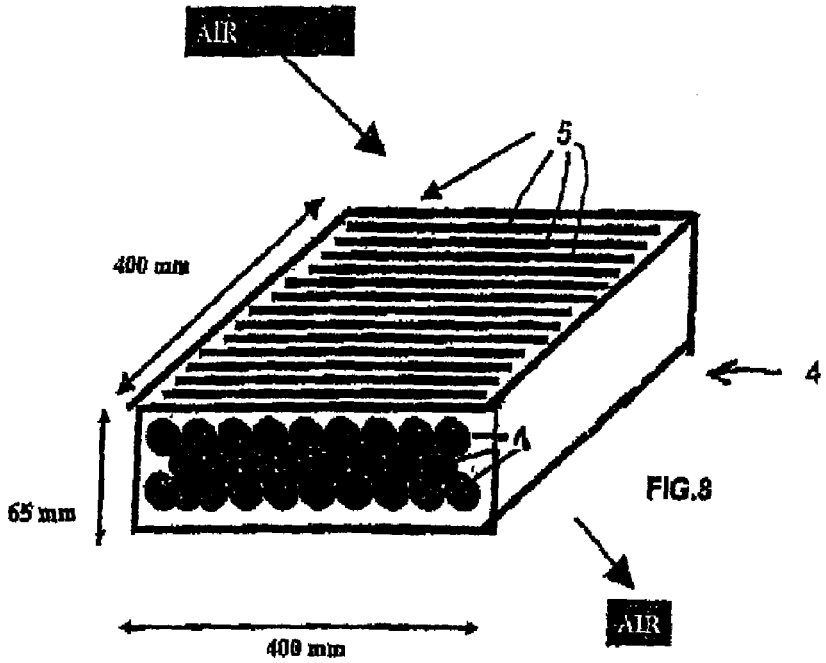

FIG. 8 is a schematic perspective view of a battery 4 used for tests, formed from tubes 1 of De=9.52 and forms a unit of the dimensions: 400 mm×400 mm×65 mm, with a density of 12 fins 5 per inch, the battery 4 comprising 3 rows of 16 grooved tubes 1 and the coolant being R22.

FIG. 6 relates to the condensation measurements on the same battery as that described above, with an air inlet temperature of 23.5° C. and a condensation temperature of 36° C. of coolant R22.

FIG. 7 relates to the evaporation measurements on the same battery, with an air inlet temperature of 26.5° C. and an evaporation temperature of 6° C. of coolant R22.

Figure 9:
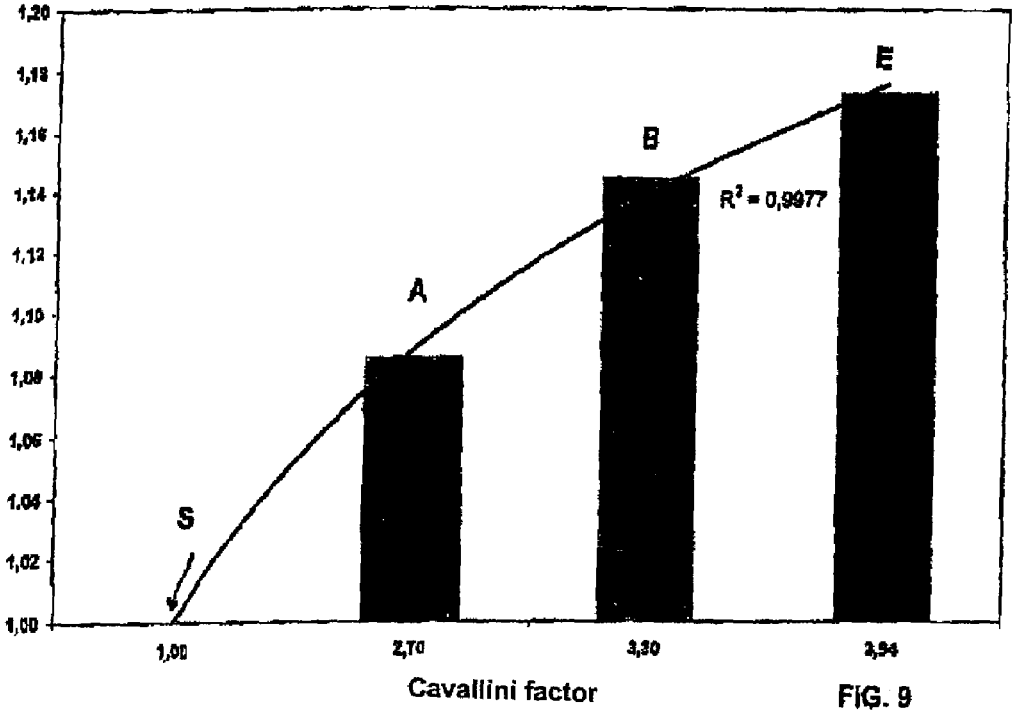

FIG. 9 is a graph which represents on the Y-axis the gain in evaporation refrigerating capacity of the batteries, in FIG. 7, with a reference air velocity of 1.25 m/s, as a function of the Cavallini factor for the different tubes tested: smooth tube S, tube E according to the invention, and tubes A and B according to the prior art.

Figure 10:
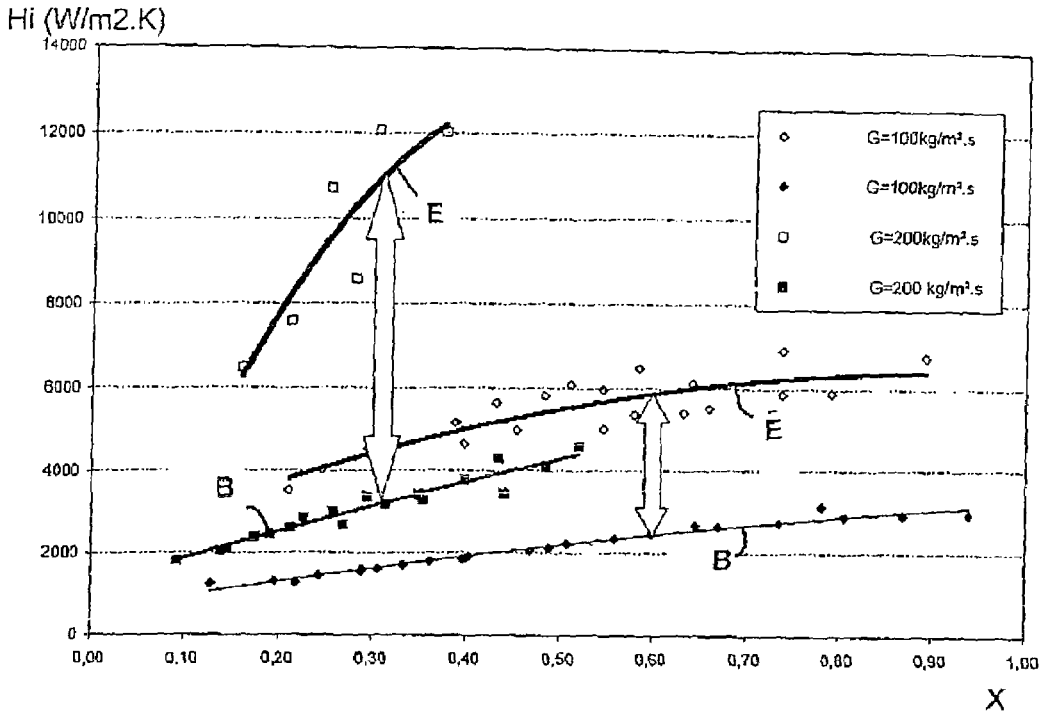

FIG. 10 is a graph showing, on the Y-axis, the heat exchange coefficient Hi ($W/m^2 \cdot K$) on tubes in evaporation with the coolant R407C, as a function of the percentage by weight of the vapor in the coolant, on the X-axis, the evaporation temperature being 5° C. The measurements were made with a heat flow of $kW/m^2$ and a mass flow rate of 100 or 200 $kg/m^2 \cdot s$ of coolant R407C, as shown in the figure, on tubes of diameter De equal to 9.52 mm.

Figure 11:
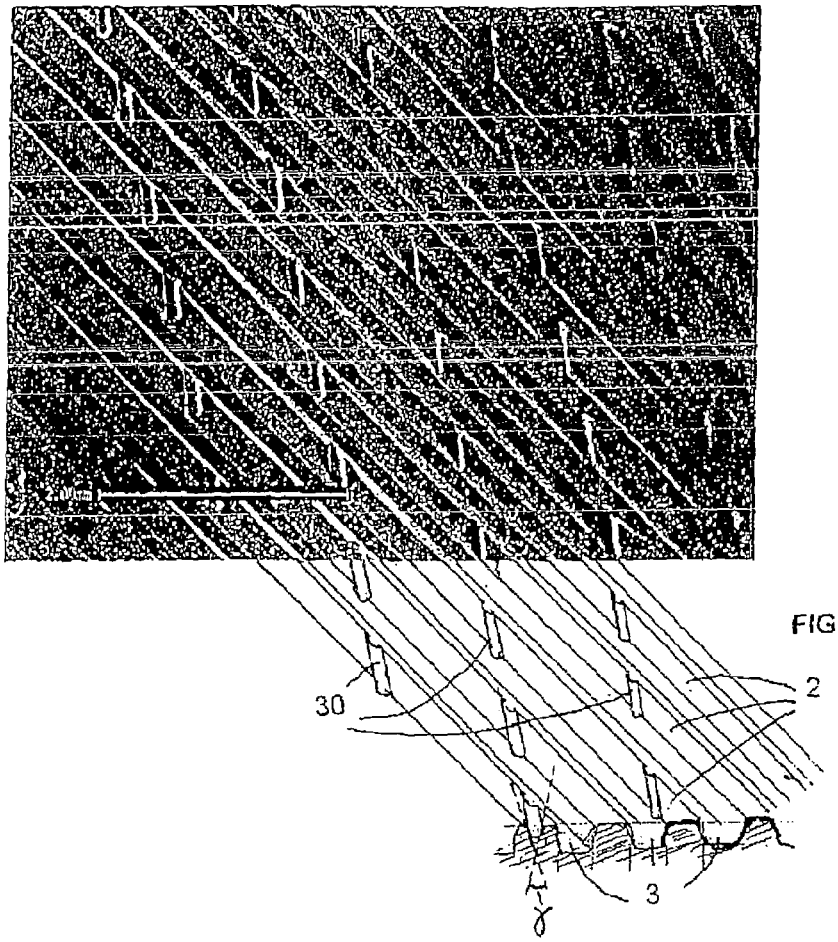

FIG. 11 is a view of a portion of the internal surface of a grooved tube according to the invention equipped with an axial counter groove 30, with a schematic representation therebelow.

DETAILED DESCRIPTION OF THE INVENTION

According to an embodiment of the invention illustrated in FIGS. 2*a* to 2*c*, said ribbing may form a succession of ribbing of height H1=H and height H2=a·H1, where a is between 0.6 and 0.9, and preferentially between 0.70 and 0.85, the value of a being in the vicinity of 0.75 in FIGS. 2*a* to 2*c*.

Typically, and as illustrated in these figures, said succession may be an alternation of ribbing of height H1 and of ribbing of height H2 separated by a typically flat groove bottom.

However, as illustrated in FIG. 3, the grooved tubes according to the invention do not necessarily comprise such an alternation of ribbing at differentiated heights as in FIGS. 2*a* to 2*c*, it being possible for the ribbing to be of roughly the same height.

Typically, in the case of tubes of diameter De of 9.52 mm, it is possible to have:

H ranging from 0.18 to 0.3 mm, and/or N less than 75, and ranging preferentially from 64 to 70.

Similarly, when De is at least equal to 9.55 mm, it is possible to have:

H ranging from 0.25 to 0.40 mm,

N ranging from 70 to 98.

Relating to the apex angle α, a preferential range of the apex angle α may range from 20° to 28°, a more restricted range from 22° to 25° providing the best compromise between requirements in terms of technical performance and those related to the expansion of the tubes with a view to their attachment to the battery fins.

Relating to the helical angle β, a preferential range of the helical angle β may range from 22° to 30° a more restricted range from 25° to 28° providing the best compromise between requirements in terms of technical performance and those related to pressure loss. This angle may vary with the inner diameter Di: it was found to be advantageous to have a β/Di ratio greater than 2.40°/mm, and preferentially greater than 3°/mm.

Preferentially, said ribbing has a "trapeze" type profile with a base of width $L_N$ and a top, joined by side edges producing said apex angle α between them, as illustrated in FIG. 2*c*, said top comprising a roughly flat central part, typically parallel to said base, but possibly sloping with reference to said base.

In any case, said top of said rib forming a small side of the trapeze may comprise rounded edges or not, i.e. with a very low radius of curvature, said edges forming a join of said top to said side edges.

Said rounded edges may comprise a radius of curvature ranging typically from 40 μm to 110 μm, and preferentially ranging from 50 μm to 80 μm, as illustrated in FIGS. 2*a* to 2*c*. Said ranges of radius of curvature correspond to a compromise between the thermal performances of the tubes and the feasibility of the tubes, the tools intended to manufacture tubes with smaller radii of curvature tending to become worn.

When the edges are not rounded, as illustrated in FIG. 3, the radius of curvature may be typically less than 50 μm, and even less than 20 μm.

According to the invention, the width $L_R$ of the flat bottom of said groove and the width $L_N$ of the base of said rib may be such that $L_R = b \cdot L_N$ where b ranges from 1 to 2, and preferentially from 1.1 to 1.8, so as to obtain a tube showing a relatively low weight per meter.

Typically, and as illustrated in FIGS. 2*a* to 2*c* and 3, said ribbing and said flat bottom of said grooves may be joined with a radius of curvature less than 50 μm, and preferentially less than 20 μm. In this case, there appears to be a better separation of the coolant liquid film from the inner wall of the tube, which favors heat exchange.

The tubes according to the invention may show, even in the absence of axial grooving, a Cavallini factor at least equal to 3.1. They may advantageously show a Cavallini factor at least equal to 3.5 and preferentially at least equal to 4.0.

The Cavallini factor Rx2^2 (Rx·Rx) involved in the exchange coefficient evaluation models, is a purely geometric factor equal to:

$$[[2 \cdot N \cdot H \cdot (1 - \mathrm{Sin}(\alpha/2))/(3.14 \cdot Di \cdot \mathrm{Cos}(\alpha/2)) + 1]/\mathrm{Cos}\ \beta]^{\wedge}2$$

So as to increase the Cavallini factor further, and as illustrated in FIG. 11, the tubes according to the invention may also comprise axial grooving 30 creating in said ribbing notches with a typically triangular profile with a rounded top, said top showing an angle γ ranging from 25 to 65°, said lower part or top is at a distance h from the bottom part of said grooves ranging from 0 to 0.2 mm.

Such an axial grooving may be obtained once said ribbing is formed by passing a grooving wheel in the axial direction.

The grooved tubes according to the invention may be made of copper and copper alloys, aluminum and aluminum alloys. These tubes may be obtained typically by tube grooving, or if applicable, by flat grooving of a metal strip followed by formation of a welded tube.

The invention also relates to heat exchangers using tubes according to the invention.

Said heat exchangers may comprise heat exchange fins in contact with said tubes on a fraction of said tubes, wherein the maximum distance between said fins and said tubes, on the fraction which is not in contact, is less than 0.01 mm, and preferentially less than 0.005 mm.

The invention also relates to the use of tubes and exchangers according to the invention, for reversible air conditioning units or multitubular heat exchangers as coolers.

EXAMPLES OF EMBODIMENTS

I—Tube Manufacture

The tests were conducted on copper tubes with an outer diameter of 8.0 mm or 9.52 mm.

The tube "E" according to the invention was manufactured according to FIGS. 2*a* to 2*c* with a diameter De of 8.0 mm, and according to FIG. 3 with a diameter De of 9.52 mm, along with the comparative tubes "S" or smooth, "C", "D", which comprise a high helical angle β (at least equal to 20°), intended for condensation according to the prior art, and comparative tubes "A" and "B", which comprise a high apex angle α (at least equal to 40°) and a low helical angle β (not more than 18°), intended for evaporation according to the prior art.

Tubes E, A, B, C were manufactured by grooving a smooth copper tube—tube S, while tube D was manufactured by means of flat grooving of a metal strip followed by formation of a welded tube.

A number of tests were conducted on copper tubes with an outer diameter De of 9.52 mm. These tubes show the following characteristics:

| Tube type | H in mm | angle α | angle β | N | Ribbing type | Tf mm | $(L_R + L_N)/L_N$ |
|---|---|---|---|---|---|---|---|
| E Fig. 3 | 0.20 | 25 | 25 | 66 | Trapezoidal | 0.30 | 2.3 |
| B | 0.20–0.17 | 40 | 16 | 74 | Alternating triangular | 0.30 | 1.88 |
| A | 0.20 | 50 | 18 | 60 | Triangular | 0.30 | 2.00 |
| C | 0.20 | 40 | 30 | 60 | Triangular | 0.30 | 1.94 |
| D | 0.20 | 15 | 20 | 72 | Crossed double ribbing* | 0.30 | 3.66 |
| S | — | — | — | — | Smooth tube | 0.30 | — |

*72 main ribs with a helical angle b equal to +20° separated by secondary grooves inclined by an angle of −20° with reference to the tube axis, the depth of the grooves being roughly equal to the height of the main ribbing.

A number of tests were conducted on copper tubes with an outer diameter De of 8.0 mm. These tubes show the following characteristics:

| Tube type | H in mm | angle α | angle β | N | Ribbing type | Tf mm | $(L_R + L_N)/L_N$ |
|---|---|---|---|---|---|---|---|
| E Fig. 3 | 0.20–0.16 | 21 | 18 | 46 | Alternating trapezoidal | 0.26 | 2.5 |
| B | 0.18–0.16 | 40 | 18 | 64 | Alternating triangular | 0.26 | 2.38 |
| A | 0.18 | 40 | 18 | 50 | Triangular | 0.26 | 2.33 |
| S | — | — | — | — | Smooth tube | 0.3 | — |

II—Battery or Exchanger Manufacture:

Finned batteries were manufactured according to FIG. 8 using these tubes, by placing the tubes in the fin collars and pushing the tube against the edge of the collars by expanding the tube using a conical mandrel. These batteries form a unit of the dimensions 400 mm×400 mm×65 mm, with a density of 12 fins per inch, the battery comprising 3 rows of 16 tubes, and the coolant being R22.

III—Results Obtained

FIGS. 4 to 7, and 9 to 10 illustrate the different results of the invention.

III-1 Results Obtained on Tubes:

a) Results obtained in condensation with coolant R22 on tubes of De equal to 9.52 mm:

| TUBES => Properties | E Fig. 3 | A | C | D | S |
|---|---|---|---|---|---|
| Weight g/m | 89 | 93.5 | 95 | 95 | 78 |
| Pressure loss dP** | 2500 ± 100 | — | 2400 ± 100 | 3000 ± 100 | |
| Cavallini factor | 3.94 | 2.72 | 3.53 | — | 1 |
| Mean exchange coefficient Hi* | 6850 ± 50 | 4950 ± 50 | 6300 ± 50 | 6000 ± 50 | 2850 ± 50 |

*Exchange coefficient Hi in $W/m^2 \cdot K$ for a fluid flow rate G equal to 350 $kg/m^2 \cdot s$. Measurement conditions: temperature of 30° C., tube length of 6 m, and fluid flow rate G equal to 350 $kg/m^2 \cdot s$.
**in Pa/m measured for a fluid flow rate equal to 350 $kg/m^2 \cdot s$.

B) Results obtained in evaporation with coolant R22 on tubes of De equal to 8.00 mm:

| TUBES => Properties | E Fig. 3 | B | A | S |
|---|---|---|---|---|
| Weight g/m | 66 | 68 | 66 | — |
| Pressure loss dP** | 6700 ± 100 | 8000 ± 100 | 7000 ± 100 | 5800 ± 100 |
| Cavallini factor | 3.13 | 3.02 | 2.68 | 1 |
| Mean exchange coefficient Hi* | 10500 ± 100 | 9500 ± 100 | 8500 ± 100 | 4500 ± 100 |

*Exchange coefficient Hi in $W/m^2 \cdot K$ for a fluid flow rate G equal to 200 $kg/m^2 \cdot s$. Measurement conditions: temperature of 0° C., tube length of 3 m, flux from 10 to 12 $kW/m^2 \cdot K$, vapour titre ranging from 0.2 to 0.9 and fluid flow rate G equal to 200 $kg/m^2 \cdot s$.
**in Pa/m measured for a fluid flow rate equal to 200 $kg/m^2 \cdot s$.

C) Results obtained in evaporation with coolant R407C on tubes of De equal to 9.52 mm:

| TUBES => Properties | E Fig. 3 | B |
|---|---|---|
| Weight g/m | 89 | 92.3 |
| Cavallini factor | 3.94 | 3.3 |
| Pressure loss dP* | 600 ± 40 | 700 ± 40 |
| Local exchange coefficient Hi* | 6000 ± 100 | 2500 ± 100 |
| Pressure loss dP** | 1200 ± 40 | 1200 ± 40 |
| Mean exchange coefficient Hi** | 11000 ± 100 | 300 ± 100 |

Measurement conditions: temperature of 5° C. and flux of 12 $kW/m^2 \cdot K$. See FIG. 10.
*Exchange coefficient Hi in $W/m^2 \cdot K$ and pressure loss dP in Pa/m taken at a fluid flow rate G equal to 100 $kg/m^2 \cdot s$ and with a mean vapour titre of 0.6.
**Exchange coefficient Hi in $W/m^2 \cdot K$ and pressure loss dP in Pa/m taken at a fluid flow rate G equal to 200 $kg/m^2 \cdot s$ and with a mean vapour titre of 0.3.

III—2 Results Obtained on Batteries:

| BATTERIES Properties | E | B | A | S |
|---|---|---|---|---|
| Condensation capacity* (watt) FIG. 6 | 5025 ± 150 | 4230 ± 127 | 4100 ± 164 | 4050 ± 121 |
| Evaporation capacity** (watt) FIG. 7 | 4650 ± 140 | 4350 ± 175 | 4200 ± 90 | 4050 ± 121 |

*for a frontal air velocity taken to be equal to 2.8 m/s.
**for a frontal air velocity taken to be equal to 1.5 m/s.

IV—Conclusions:

All these results demonstrate that the tubes and exchangers or tube batteries according to the invention offer superior properties with respect to comparable products of the prior art, both in evaporation and condensation.

As a result, surprisingly, the tubes according to the invention not only represent a good compromise of evaporation and condensation performances, but also offer, in absolute terms, excellent performances with respect to the tubes of the prior art used in evaporation and those used in condensation, which is of major interest in practice.

In addition, relating to the weight per metre, the values obtained with the tubes according to the invention correspond to a gain ranging from 3.7 to 6.7% with respect to the tubes according to the prior art, taken at the same diameter and same thickness Tf, which is considered as very important.

Finally, the type E tubes according to the invention may be manufactured advantageously by high output grooving of smooth non-grooved copper tubes, typically at a grooving rate similar to that used for type B tubes, i.e. at least 80 m/min.

The invention offers great advantages.

Indeed, firstly, the tubes and batteries obtained according to the invention offer high intrinsic performances.

Secondly, these performances are high both in terms of evaporation and condensation, enabling the use of the same tube for both applications.

In addition, the tubes have a relatively low weight per metre, which is very advantageous both from a practical point of view, and economical point of view with a relatively low material cost.

Finally, the tubes according to the invention do not require specific manufacturing means. They can be manufactured with standard equipment, and particularly at standard production rates.

What is claimed is:

1. Grooved metal tubes (1), of thickness $T_f$ at the bottom of the groove, outer diameter De, intended for the manufacture of heat exchangers operating in evaporation or condensation or in reversible mode and using a phase transition coolant, said tubes being grooved internally with N helical ribs (2) of an apex angle α, height H, base width $L_N$ and helical angle β, two consecutive ribs being separated by a typically flat-bottomed groove (3) of width $L_R$, with a pitch P equal to $L_R+L_N$, and wherein said tubes show a Cavallini factor at least equal to 3.1, the tubes further comprising an axial grooving creating in said ribbing notches with a triangular profile with a rounded top, said top showing an angle y ranging from 25 to 65°, said top is at a distance h from the bottom of said grooves ranging from 0 to 0.2 mm, characterised in that, a) the outer diameter De is between 4 and 20 mm, b) the number N of ribs ranges from 46 to 98, particularly as a function of the diameter De, c) the rib height H ranges from 0.18 mm to 0.40 mm, particularly as a function of the diameter De, d) the apex angle α ranges from 15° to 30°, e) the helical angle β ranges from 18° to 35°, so as to obtain simultaneously a high heat exchange coefficient both in evaporation and condensation, a low pressure loss and the lightest possible tube.

2. Tubes according to claim 1 wherein, when De is less than or equal to 9.55 mm, this gives:

H ranging from 0.18 to 0.3 mm, and/or N less than 75.

3. Tubes according to claim 1 wherein, when De is at least equal to 9.55 mm, this gives:

H ranging from 0.25 to 0.40 mm,

N ranging from 70 to 98.

4. Tubes according to claim 1 wherein the apex angle α ranges from 20° to 28 °.

5. Tubes according to claim 4 wherein the apex angle α ranges from 22° to 25°.

6. Tubes according to claim 1 wherein the helical angle β ranges from 22° to 30°.

7. Tubes according to claim 1 wherein the helical angle β ranges from 25° to 28°.

8. Tubes according to claim 1 wherein said ribbing has a "trapeze" type profile with a base and a top, said top comprising a roughly flat central part, substantially parallel to said base.

9. Tubes according to claim 1 wherein the width $L_R$ of the flat bottom of said groove and the width $L_N$ of the base of said rib are such that that $L_R=b\cdot L_N$ where b ranges from 1 to 2.

10. Tubes according to claim 1 wherein said ribbing and said flat bottom of said grooves are joined with a radius of curvature less than 50 μm.

11. Tubes according to claim 1 wherein the Cavallini factor is at least equal to 3.5.

12. Tubes according to claim 1 made of copper and copper alloys.

13. Tubes according to claim 1 obtained by tube grooving, or if applicable, by flat grooving of a metal strip followed by formation of a welded tube.

14. A heat exchanger, comprising: a plurality of grooved metal tubes according to claim 1.

15. A reversible air conditioning unit, comprising: a plurality of grooved metal tubes according to claim 1.

16. A multitubular heat exchanger, comprising: a plurality of grooved metal tubes according to claim 1.

17. Tubes according to claim 2 wherein, when De is less than or equal to 9.55 mm, this gives:

H ranging from 0.20 to 0.25 mm.

18. Tubes according to claim 1 wherein, when De is less than or equal to 9.55 mm, this gives:

N less than 75.

19. Tubes according to claim 1 wherein, when De is less than or equal to 9.55 mm, this gives:

N ranging from 64 to 70.

20. Tubes according to claim 9 wherein the width $L_R$ of the flat bottom of said groove and the width $L_N$ of the base of said rib are such that that $L_R=b\cdot L_N$ where b ranges from 1.10 to 1.8.

21. Tubes according to claim 10 wherein said ribbing and said flat bottom of said grooves are joined with a radius of curvature less than less than 20 μm.

22. Tubes according to claim 11 wherein the Cavallini factor is at least equal to 4.0.

23. Tubes according to claim 1 made of aluminium and aluminium alloys.

* * * * *